US005210511A

United States Patent [19]

Izumi et al.

[11] Patent Number: 5,210,511

[45] Date of Patent: May 11, 1993

[54] DIELECTRIC RESONATOR AND PROCESS FOR MANUFACTURING THE SAME

[75] Inventors: Yasuhiro Izumi; Ryoichi Makimoto; Takehiko Yoneda; Hiromitsu Taki, all of Miyazaki, Japan

[73] Assignee: Matsushita Electric Industrial Co., Ltd., Osaka, Japan

[21] Appl. No.: 795,149

[22] Filed: Nov. 20, 1991

[30] Foreign Application Priority Data

Nov. 20, 1990 [JP] Japan ..... 2-317263

[51] Int. Cl.[5] ..... H01P 7/04

[52] U.S. Cl. ..... 333/222; 333/219.1

[58] Field of Search ..... 333/202, 206, 207, 219.1, 333/234, 222-226; 29/600

[56] References Cited

U.S. PATENT DOCUMENTS 4,668,925 5/1987 Towatari et al. ..... 333/219.1

5,004,992 4/1991 Grieco et al. ..... 333/223 X

FOREIGN PATENT DOCUMENTS 0179001 10/1983 Japan ..... 333/202

0123801 5/1990 Japan ..... 333/222

*Primary Examiner*—Robert J. Pascal

*Assistant Examiner*—Seung Ham

*Attorney, Agent, or Firm*—Lowe, Price, LeBlanc & Becker

[57] ABSTRACT

A dielectric resonator comprising a cylindrical substrate comprised of a dielectric ceramic, a first conductive film comprised of copper, formed on the inner surface, outer surface and one end of said cylindrical substrate, and a second conductive film comprised of at least one solder and tin, formed on said first conductive film. Thus the dielectric resonator of the present invention can be free from oxidation of the copper film when heating is carried out not in an inert gas environment but in the atmosphere. Hence it becomes unnecessary to use various devices for carrying out the heating in an inert gas environment as so required in the conventional cases. This also enables reduction of the number of processing steps, resulting in an improvement in productivity. Moreover, its weatherability can be improved, so that it can promise a long lifetime.

6 Claims, 6 Drawing Sheets

DIELECTRIC RESONATOR AND PROCESS FOR MANUFACTURING THE SAME

BACKGROUND OF THE INVENTION

1. Field of the Invention

This invention relates to a dielectric resonator for high frequencies, used in communication machinery, and also relates to a process for its manufacture.

2. Description of the Prior Art

As a material for conductive films of dielectric resonators for high frequencies, silver has been hitherto commonly used. In the formation of a conductive film comprised of silver, silver baking has been used. For this purpose, a silver paste comprising a mixture of at least silver and glass frit is adhered to a dielectric ceramic by a coating means such as brushing, followed by heating to bake silver metal on the surface of the dielectric ceramic so that a conductive film is formed. Hence, although the silver has originally an electrical conductivity of $6.06\times10^5$ ($1/\Omega$.cm), the silver conductive film formed by this baking results in a low electrical conductivity which is about 20% of the original conductivity, because of the presence of the glass frit mixed. Since, however, this glass frit is added for the purpose of obtaining an adhesion strength between the dielectric ceramic for high frequencies and the silver metal, an attempt to form a conductive film using a silver paste not containing this glass frit brings about a serious lowering of the adhesion strength between the conductive film and the dielectric ceramic, making it impossible to use the film as a conductive film. Since also the silver is an expensive metal, there is an anxiety for a high manufacture cost.

Under such circumstances, it is attempted to use inexpensive copper as a material for the conductive film in place of the expensive silver. In the case when copper conductive films are formed, they are usually formed by plating. However, the conductive film having been formed by plating without any additional treatment has so low an electrical conductivity that the value Q of a dielectric resonator comprising such a conductive film formed becomes smaller. Hence, after the conductive film has been formed on the ceramic, the conductive film must be subjected to a heat treatment carried out in an environment of inert gas such as nitrogen or argon so that the electrical conductivity of the conductive film can be increased. The reason why the heating is carried out in an environment of inert gas is to prevent the conductive film from being oxidized to make solderability poor or its contact resistance from becoming greater.

Since, however, the formation of conductive films by such a method requires the heating carried out in an inert gas environment, this method has been involved in the problem that the manufacturing process is complicated to bring about a poor productivity. It has been also involved in the problem that the conductive films formed of copper usually tend to become corroded.

SUMMARY OF THE INVENTION

The present invention solves the above problems involved in the prior art, and its object is to provide a dielectric resonator that can achieve a high value Q when it is produced by carrying out the heating not in an environment that requires many steps as in the inert gas environment but in the atmosphere that requires less steps, and yet can promise a good weatherability. Another object of the present invention is to provide a process for manufacturing such a dielectric resonator.

As a first embodiment of the dielectric resonator, the present invention provides a dielectric resonator comprising;

a cylindrical substrate comprised of a dielectric ceramic;

a first conductive film comprised of copper, formed on the whole surface of said cylindrical substrate except one end thereof; and a second conductive film comprised of at least one of solder and tin, formed on said first conductive film in such a manner that it covers said one end of said first conductive film.

The dielectric resonator according to the first embodiment of the present invention can be manufactured by a process comprising the steps of;

forming on the surface of a cylindrical substrate comprised of a dielectric ceramic, a first conductive film comprised of copper;

laminating a second conductive film comprised of at least one of solder and tin, to said first conductive film;

thereafter removing said first conductive film and second conductive film at their ends corresponding to one end of said substrate; and heating said substrate and said first and second conductive films.

As a second embodiment of the dielectric resonator, the present invention provides a dielectric resonator comprising;

a cylindrical substrate comprised of a dielectric ceramic;

a first conductive film comprised of copper, formed on the inner surface, outer surface and one end of said cylindrical substrate; and a second conductive film comprised of at least one of solder and tin, formed on said first conductive film.

The dielectric resonator according to the second embodiment of the present invention can be manufactured by a process comprising the steps of;

forming on the surface of a cylindrical substrate comprised of a dielectric ceramic, a first conductive film comprised of copper;

laminating a second conductive film comprised of at least one of solder and tin, to said first conductive film;

thereafter heating said substrate and said first and second conductive films; and removing said first conductive film and second conductive film at their ends corresponding to one end of said substrate.

DESCRIPTION OF THE PREFERRED EMBODIMENTS

Figure 1A:
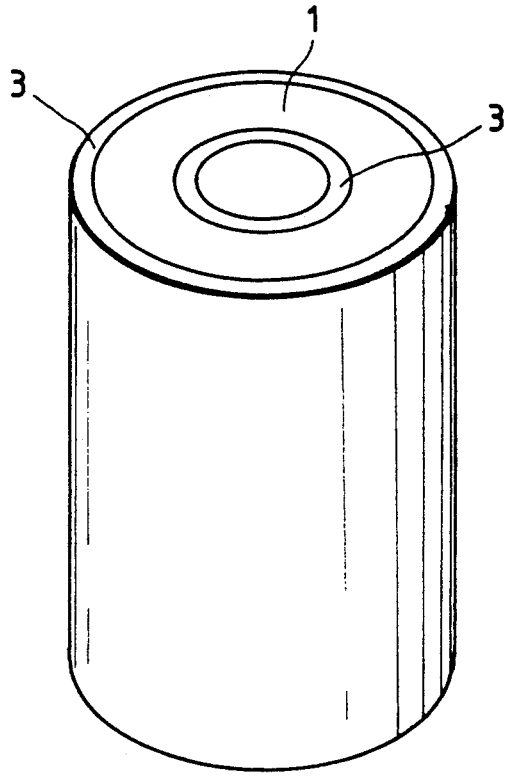
FIGS. 1A and 1B are a perspective view and a sectional view, respectively, of a dielectric resonator according to the first embodiment of the present invention.
Figure 1B:
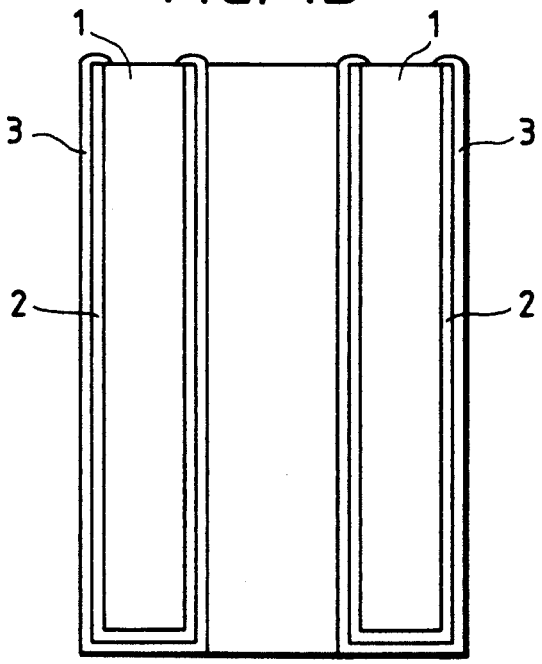

FIGS. 1A and 1B are a perspective view and a sectional view, respectively, of a dielectric resonator according to the first embodiment of the present invention. In FIGS. 1A and 1B, reference numeral 1 denotes a cylindrical substrate comprised of a $BaTiO_3$ type or $MgTiO_3$ type dielectric ceramic material for high frequencies; and 2, a first conductive film formed on the whole surface of the substrate 1 except one end thereof. The first conductive film 2 is comprised of copper. Reference numeral 3 denotes a second conductive film formed on the first conductive film in a thickness of, for example, 2 μm. The second conductive film 3 is formed of at least one of solder and tin. Here, at the end on which the first conductive film 2 is not provided, the second conductive film 3 is formed only on its peripheral portion of said end in such a manner that it covers the uncovered end of the first conductive film 2.

A process for manufacturing the dielectric resonator of the present embodiment thus constructed will be described below.

First, a kneaded product comprised of a $BaTiO_3$ type or $MgTiO_3$ type dielectric ceramic material for high frequencies is molded into a cylinder with, for example, an inner diameter of 2.0 mm, an outer diameter of 8.0 mm and a height of 14.0 mm to produce the substrate 1. Here, the substrate 1 is so made as to have a surface roughness between 0.1 μm and 15.0 μm. Next, the first conductive film 2 is formed by plating on the inner surface, outer surface and both ends of the substrate 1, i.e., on the whole surface of the substrate 1. Subsequently, the second conductive film 3 formed of at least one of solder and tin is formed by plating on the first conductive film 2. Then, one end of the substrate 1 provided thereon with the films is abraded by a conventional means to remove the first and second conductive films 2 and 3 at that end. Next, the substrate 1 on which the first and second conductive films 2 and 3 have been formed except that end is heated in the atmosphere at a temperature ranging between the solidus (or melting curve) temperature of solder and 300° C. As a result, at the surface on which the first and second conductive films 2 and 3 have been abraded, the second conductive film 3 is melted to cover the part at which the first conductive film 2 is uncovered. Thus the dielectric resonator as shown in FIG. 1 can be produced. In the dielectric resonator thus obtained, the first conductive film 2 is not exposed to the air, so that the first conductive film 2 can be free from corrosion and its stable characteristics can be maintained for a long time.

The relationship of the value Q of the dielectric resonator with respect to the layer thickness of the first conductive film 2 and the heating temperature will be described below in the form of an experimental report.

Figure 2:
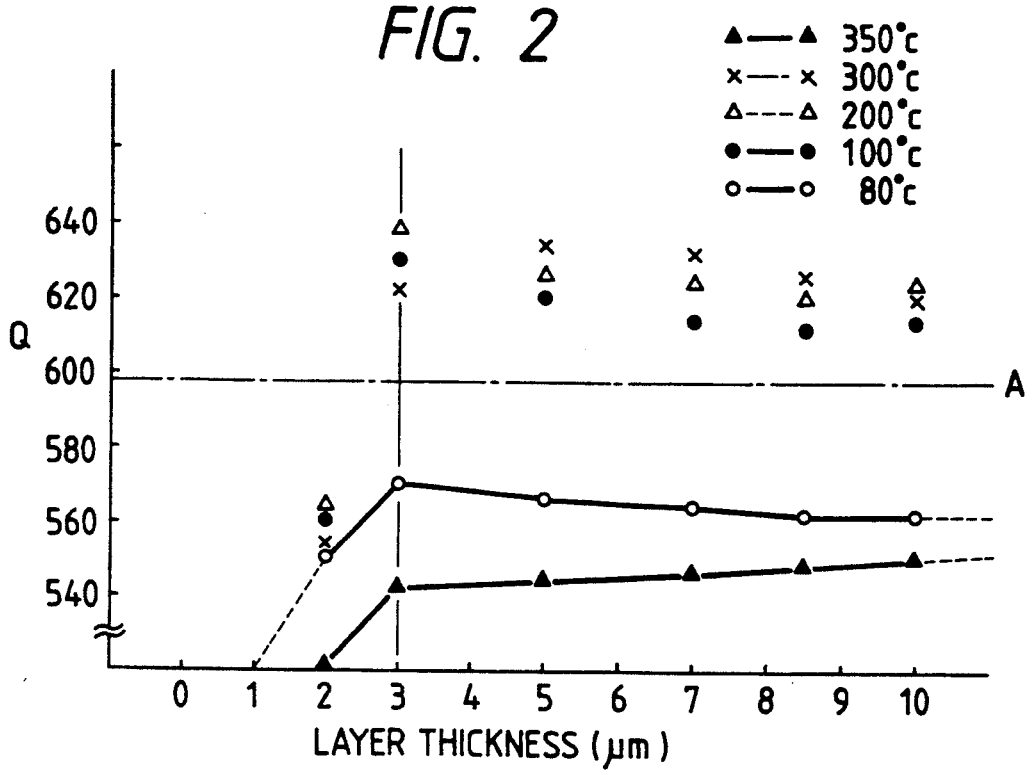
FIG. 2 is a graph to show the relationship between the layer thickness of a first conductive film of the dielectric resonator according to the first embodiment and value Q.
Figure 6:
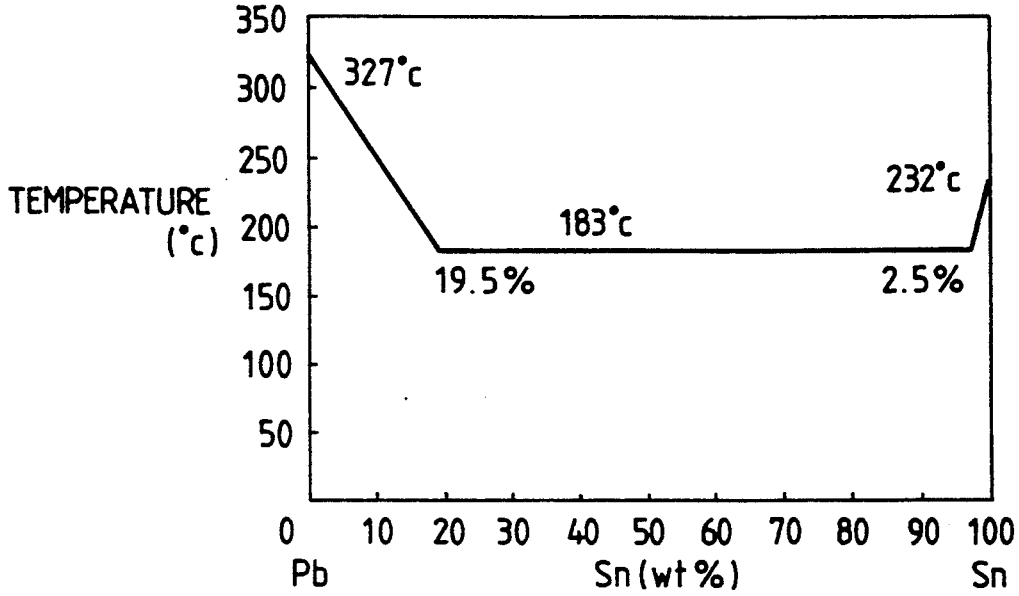
FIG. 6 is a graph to show solidus (or melting curve) temperature of solder.

First, the first conductive film 2 was formed by electroless plating. Here, a plurality of samples were prepared in which the layer thickness of the first conductive film 2 was varied in the range of from 2 μm to 10 μm. Next, the second conductive film 3 was formed on each first conductive film 2 by electroplating of solder in a thickness of 2 μm. Subsequently, heating was carried out in the atmosphere, where the heating temperature was varied to 80° C., 100° C., 200° C., 300° C. and 350° C. Here, the heating was carried out for about 30 minutes when its temperature was 350° C., 300° C. or 200° C.; for 3 hours when it was 100° C., and for several ten hours when it was 80° C. Then, how the value Q of the dielectric resonator changes with variations in the layer thickness of the first conductive film 2 and in the heating temperature was examined to obtain the results as shown together in FIG. 2. The value Q can be measured by the reflection method, using NET WORK ANALYZER 8753C, trade name, manufactured by Hewlett Packard Co., or S-PARAMETER TEST SET 85047A, trade name, manufactured by Hewlett Packard Co. FIG. 2 is a graph to show the relationship between the layer thickness of the first conductive film and value Q. As will be seen from FIG. 2, the value Q is substantially constant and stable when the layer thickness of the first conductive film is 3 μm or more (up to about 20 μm taking account of merit in cost). The chain line A shown in FIG. 2 indicates the value Q determined when a silver film is used as the conductive film and the silver film is made to have a thickness of from 30 μm to 40 μm (the thickness usually used). Thus, it is understood that the value Q is greater than that of the silver conductive film conventionally used, when the first conductive film has a thickness of 3 μm or more. FIG. 2 also shows that the value Q can be sufficiently large when the heating temperature is in the range of from 100° C. to 300° C. It also shows that the value Q is very small when the heating temperature is 100° C. or below or 300° C. or above, compared with the cases of other temperatures. Thus, the value Q can be made sufficiently large when the first conductive film has a layer thickness of 3 μm or more and also the heating temperature is set in the range of from 100° C. to 300° C. However, in order for the second conductive film to be melted to cover the first conductive film at its part uncovered by abrasion of the first conductive film and second conductive film, it must be heated at a temperature higher than the solidus temperature of solder. FIG. 6 is a graph to show the relationship between the content of tin in solder and the solidus temperature of solder. This graph shows that the above heating must be carried out at a temperature ranging from 183° C. to 300° C. in an instance where a solder with a tin content of from about 18% by weight to about 95% by weight is used in the second conductive film. Hence, the heating must be carried out at a temperature not lower than the solidus temperature of the second conductive film and not higher than 300° C.

Another embodiment of the above dielectric resonator will be described below.

Figure 3:
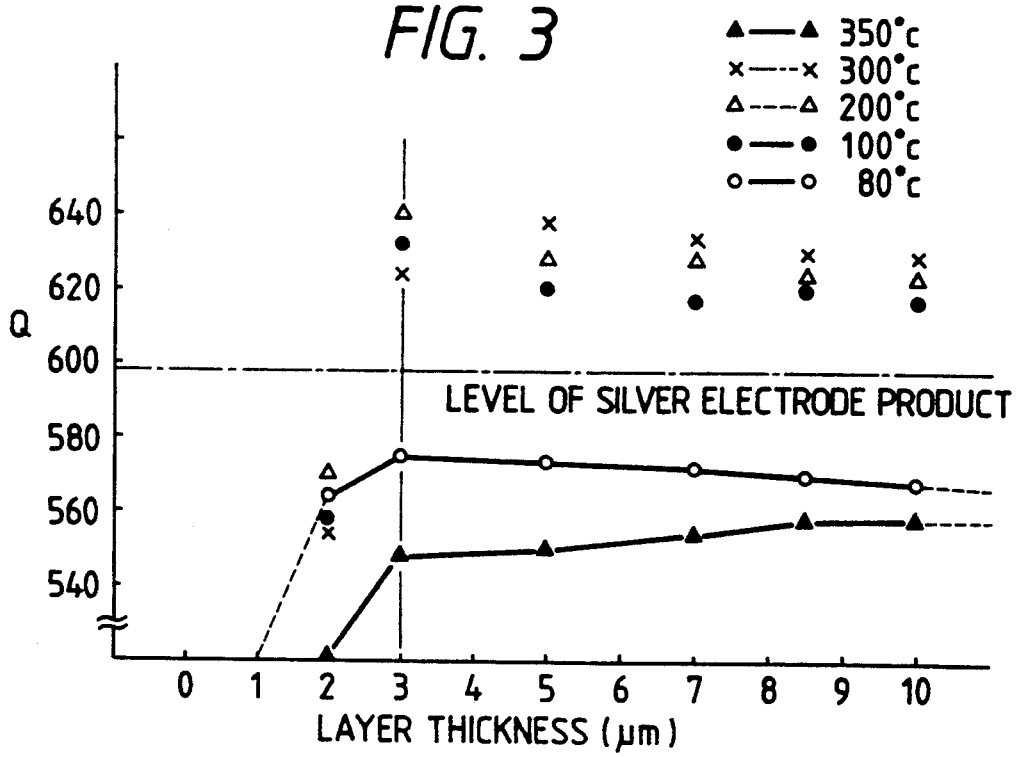
FIG. 3 is a graph to show the relationship between the layer thickness of a first conductive film according to another embodiment in the first embodiment and value Q.

In this embodiment, a dielectric resonator has the same substrate 1, second conductive film 3 and the appearance as those shown in FIGS. 1A and 1B, and also is produced in the same process in that the heating is carried out in the atmosphere and at a heating temperature not lower than the solidus temperature of solder and not higher than 300° C. In this embodiment, however, the first conductive film is prepared in a different manner. That is, first, a copper film is formed by copper electroless plating on the substrate 1 in a thickness of from 0.5 μ to 2.0 μm, and another copper film is formed by copper electroplating so as to be laminated onto the first copper film in a thickness of 3 μm or more. In this way, forming first a subbing film by copper electroless plating and forming on the subbing film another copper film by copper electroplating makes it possible to form the first conductive film at a higher rate (i.e., in a shorter time). The reason therefor is as follows: If it is attempted to form a copper film by copper electroless plating, the film is formed at a very low rate. Hence, the first conductive film could be formed at a higher rate if, after the copper film has been formed by copper electroless plating to a certain extent, the film is formed by copper electroplating that enables film-formation at a high rate. If so, it may be considered that the film should be formed by copper electroplating from the beginning. Since, however, the substrate 1 is comprised of a ceramic, i.e., an insulator, no copper film can be formed on the substrate 1 if the copper electroplating is applied from the beginning. Also in regard to this another embodiment constituted as described above, the relationship of the value Q of the dielectric resonator with respect to the layer thickness of the first conductive film and the heating temperature is shown in FIG. 3. As will be seen from FIG. 3, substantially the same results as those in FIG. 2 are obtained, that is, the value Q of the dielectric resonator can be made larger when the first conductive film of the double layer structure is formed in a thickness of 3 μm or more and also the heating temperature is set in the range of from 100° C. to 300° C. However, as previously described, in order for the second conductive film to be melted to cover the first conductive film at its part uncovered by abrasion of the first conductive film and second conductive film, it must be heated at a temperature higher than the solidus temperature of solder. Hence, the heating must be carried out at a temperature not lower than the solidus temperature of solder and not higher than 300° C. In this embodiment, the second conductive film is formed by solder electroplating. The same effect can be obtained also when a tin film is formed by tin electroplating.

Figure 4:
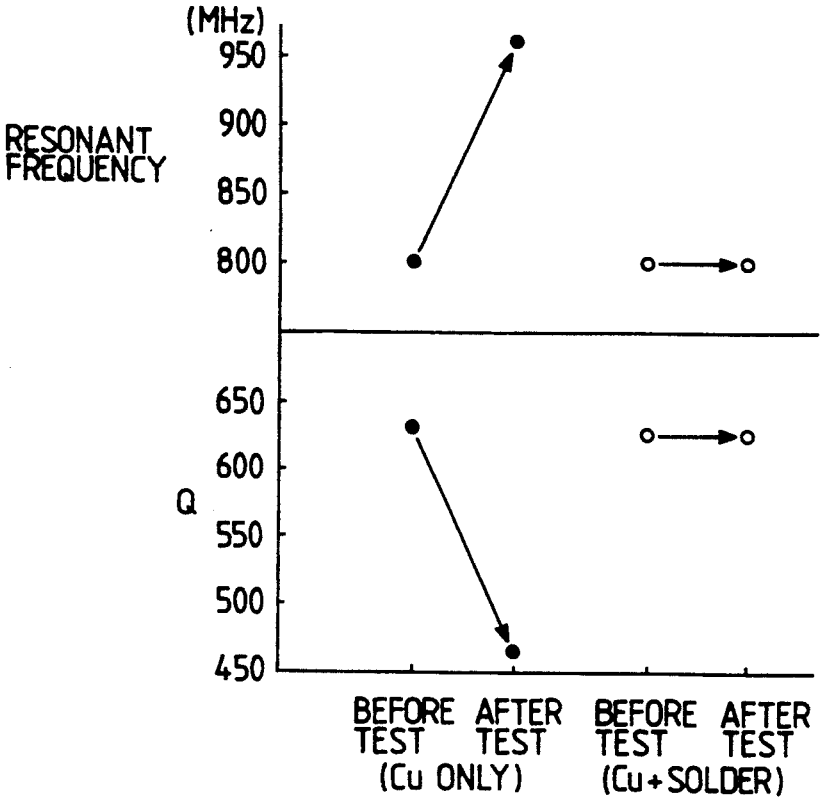
FIG. 4 is a graph to show changes in value Q and resonant frequencies before and after salt spray tests carried out on a dielectric resonator of the prior art and that of the first embodiment of the present invention.

Then the dielectric resonator according to another embodiment described above and a conventional dielectric resonator having a conductive film formed of only copper were subjected to salt spray tests according to JIS 5028. Results obtained are shown in FIG. 4. In FIG. 4, the changes in unloading value Q and changes in resonant frequencies before and after the salt spray tests are shown in the lower half and upper half, respectively, of the graph. As will be seen from FIG. 4, in the conventional dielectric resonator, the value Q and resonant frequencies obtained before the tests are greatly changed after the tests. This is presumably because the copper film has been corroded by salt water. On the other hand, in the dielectric resonator according to another embodiment described above, almost no changes are seen in the value Q and resonant frequencies before and after the tests.

The thickness of the second conductive film (a solder film or a tin film) will be described below. In the above first embodiment and another embodiment thereof, the second conductive film is formed in a thickness of 2 μm. In practice, the intended characteristics can be obtained if it is in a thickness of at least 1 μm. A layer thickness less than 1 μm may result in disappearance of the second conductive film because of diffusion thereof to the first conductive film during the heating, or as a result of its oxidation. Hence, the second conductive film must have a layer thickness of at least 1 μm. Although it has been stated in the above that the second conductive film 3 may have a layer thickness of not less than 1 μm, it should have a layer thickness of not more than 5 μm at most from the viewpoint of productivity. This is because a layer thickness more than 5 μm makes it necessary to carry out the plating for a long time. From the viewpoint of its characteristics, it may be in a layer thickness of not less than 1 μm without any other problem.

Figure 5:
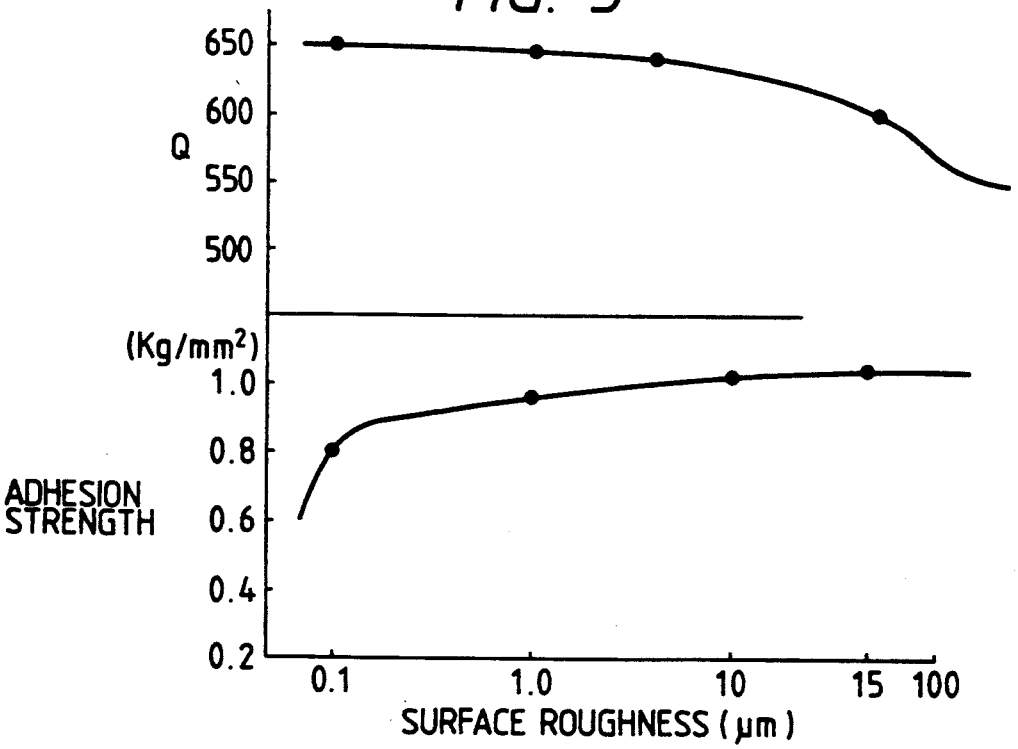
FIG. 5 is a graph to show the relationship between surface roughness of a substrate and value Q and between the surface roughness and adhesion strength of the first conductive film to the substrate, in the first embodiment of the present invention.

The surface roughness of the substrate 1 will be described below. FIG. 5 shows the relationship between surface roughness of the substrate 1 and adhesion strength of the first conductive film to the substrate, and between the surface roughness and unloading value Q, which are shown in the lower half and upper half, respectively, of the graph. As will be seen from FIG. 5, the adhesion strength becomes substantially not less than 0.8 when the surface roughness is 0.1 μm or more, and hence the surface roughness of not less than 0.1 μm is satisfactory from the viewpoint of adhesion strength. FIG. 5 also shows that the value Q abruptly decreases when the surface roughness is 15.0 μm or more. Hence, from the viewpoint of the value Q, the surface roughness should be not more than 15 μm. Thus, it is seen from the foregoing that the substrate 1 should have a surface roughness of from 0.1 μm to 15.0 μm.

The surface roughness can be measured using, for example, a surface roughness meter SURFCORDER, trade name, manufactured by Kosaka Laboratory Ltd. The ceramic surface roughness can be controlled by a conventionally known method such as the ceramic combustion method, the ceramic abrasion method or a method in which an additive is added to the ceramic material. The adhesion strength can also be measured by a conventionally known method.

As described above, according to the first embodiment of the dielectric resonator of the present invention, the first conductive film made of copper is formed on the substrate 1 and the second conductive film made of solder or tin is formed on the first conductive film. Providing of the second conductive film makes it possible to carry out the heating in the atmosphere. Hence, it becomes unnecessary to use various devices for carrying out the heating in an inert gas environment as so required in the conventional cases. Moreover, this enables reduction of the number of processing steps, resulting in an improvement in productivity. Furthermore, the heating of the substrate 1 and the first and second conductive films at temperatures of from 100° C. to 300° C. and the controlling the substrate to have a surface roughness of from 0.1 μm to 15.0 μm make it possible to obtain a high value Q and also to enhance the adhesion strength between the first conductive film and the substrate 1. Still further, since the first conductive film is completely covered with the second conductive film, the first conductive film can be free from corrosion, making it possible to maintain stable characteristics for a long period of time.

In the above embodiment, the heating is carried out in the atmosphere. The same effect can be obtained also when the heating is carried out in a high-temperature oil comprising silicone, fluid paraffin or the like.

The second embodiment of the dielectric resonator will be described below.

Figure 7:
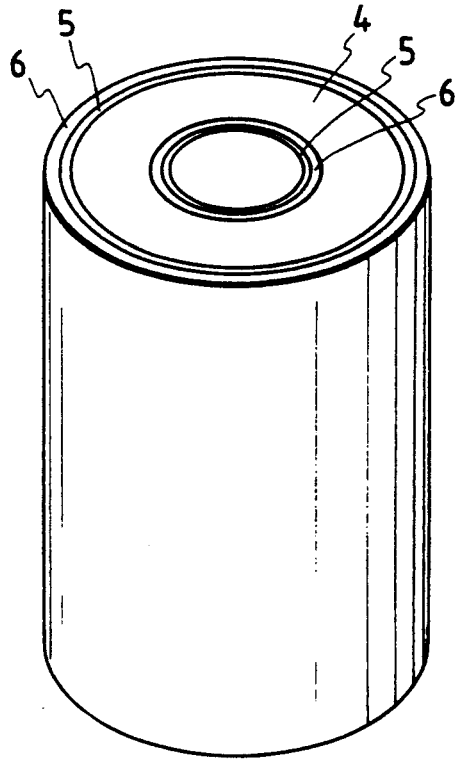
FIG. 7 is a perspective view of a dielectric resonator according to the second embodiment of the present invention.

FIG. 7 is a perspective view of a dielectric resonator according to the second embodiment of the present invention. In FIG. 7, reference numeral 4 denotes a cylindrical substrate comprised of a $BaTiO_3$ type or $MgTiO_3$ type dielectric ceramic material for high frequencies; and 5, a first conductive film formed on the whole surface of the substrate 4 except one end thereof. The first conductive film 5 is comprised of copper. Reference numeral 6 denotes a second conductive film formed on the first conductive film in a thickness of, for example, 2 μm. The second conductive film 6 is formed of at least one of solder and tin.

A process for manufacturing the dielectric resonator of the present embodiment thus constructed will be described below.

First, a kneaded product comprised of a $BaTiO_3$ type or $MgTiO_3$ type dielectric ceramic material for high frequencies is molded into a cylinder with, for example, an inner diameter of 2.0 mm, an outer diameter of 8.0 mm and a height of 14.0 mm to produce the substrate 4. Here, the substrate 4 is so made as to have a surface roughness between 0.1 μm and 15.0 μm. Next, the first conductive film 5 is formed by plating on the inner surface, outer surface and both ends of the substrate 4, i.e., on the whole surface of the substrate 4. Subsequently, the second conductive film 6 formed of at least one of solder and tin is formed by plating on the first conductive film 5. Next, the substrate 4 on which the first and second conductive films 5 and 6 have been formed is heated in the atmosphere at a temperature of from 100° C. to 300° C. Then, one end of the substrate 4 provided thereon with the films is abraded by a conventional means to remove the first and second conductive films 5 and 6 at that end. Thus the dielectric resonator as shown in FIG. 7 can be produced.

The relationship of the value Q of the dielectric resonator with respect to the layer thickness of the first conductive film 5 and the heating temperature will be described below in the form of an experimental report.

Figure 8:
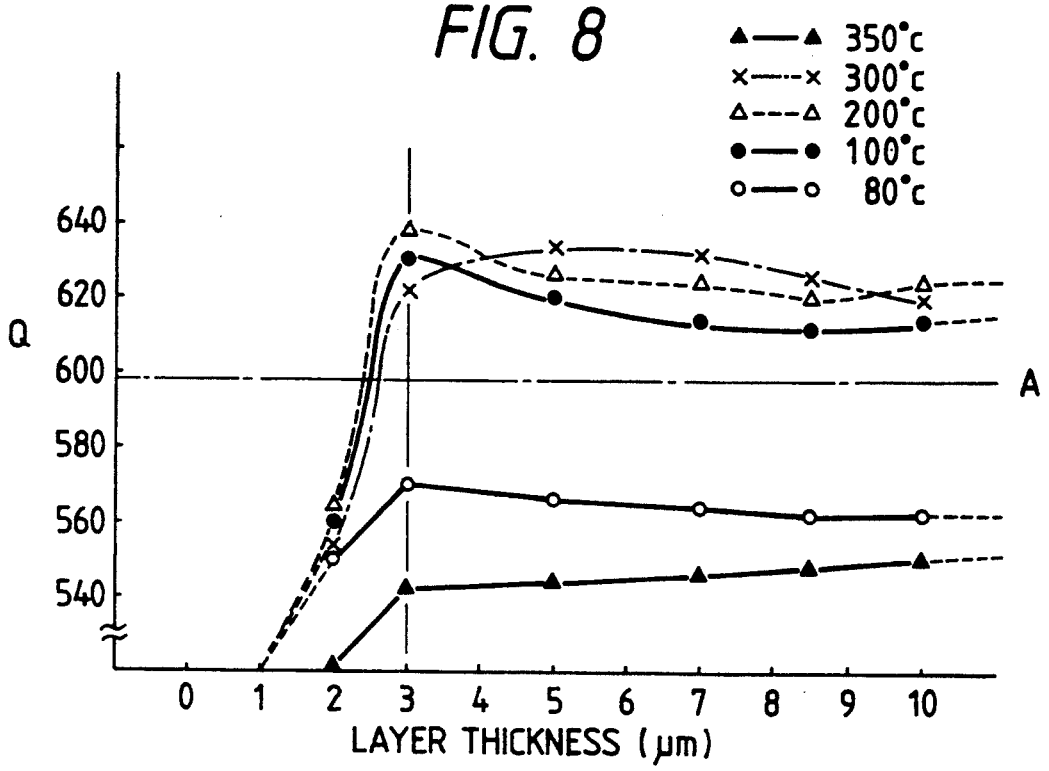
FIG. 8 is a graph to show the relationship between the layer thickness of a first conductive film of the dielectric resonator according to the second embodiment and value Q.

First, the first conductive film 5 was formed by electroless plating. Here, a plurality of samples were prepared in which the layer thickness of the first conductive film 5 was varied in the range of from 2 μm to 10 μm. Next, the second conductive film 6 was formed on each first conductive film 5 by electroplating of solder in a thickness of 2 μm. Subsequently, heating was carried out in the atmosphere, where the heating temperature was varied to 80° C., 100° C., 200° C., 300° C. and 350° C. Here, the heating was carried out for about 30 minutes when its temperature was 350° C., 300° C. or 200° C.; for 3 hours when it was 100° C., and for several ten hours when it was 80° C. Then, how the value Q of the dielectric resonator changes with variations in the layer thickness of the first conductive film 5 and in the heating temperature was examined to obtain the results as shown together in FIG. 8. FIG. 8 is a graph to show the relationship between the layer thickness of the first conductive film and value Q. As will be seen from FIG. 8, the value Q is substantially constant and stable when the layer thickness of the first conductive film is 3 μm or more (up to about 20 μm taking account of merit in cost). The chain line A shown in FIG. 8 indicates the value Q determined when a silver film is used as the conductive film and the silver film is made to have a thickness of from 30 μm to 40 μm (the thickness usually used). Thus, it is understood that the value Q is greater than that of the silver conductive film conventionally used, when the first conductive film has a thickness of 3 μm or more. FIG. 8 also shows that the value Q can be sufficiently large when the heating temperature is in the range of from 100° C. to 300° C. It also shows that the value Q is very small when the heating temperature is 100° C. or below or 300° C. or above, compared with the cases of other temperatures. Thus, the value Q can be made sufficiently large when the first conductive film has a layer thickness of 3 μm or more and also the heating temperature is set in the range of from 100° C. to 300° C.

Another embodiment of the above dielectric resonator will be described below.

In this embodiment, a dielectric resonator has the same substrate 4, second conductive film 6 and the appearance as those shown in FIGS. 1A and 1B, and also is produced in the same process in that the heating is carried out in the atmosphere and at a heating temperature of from 100° C. to 300° C. In this embodiment, however, the first conductive film is prepared in a different manner.

Figure 9:
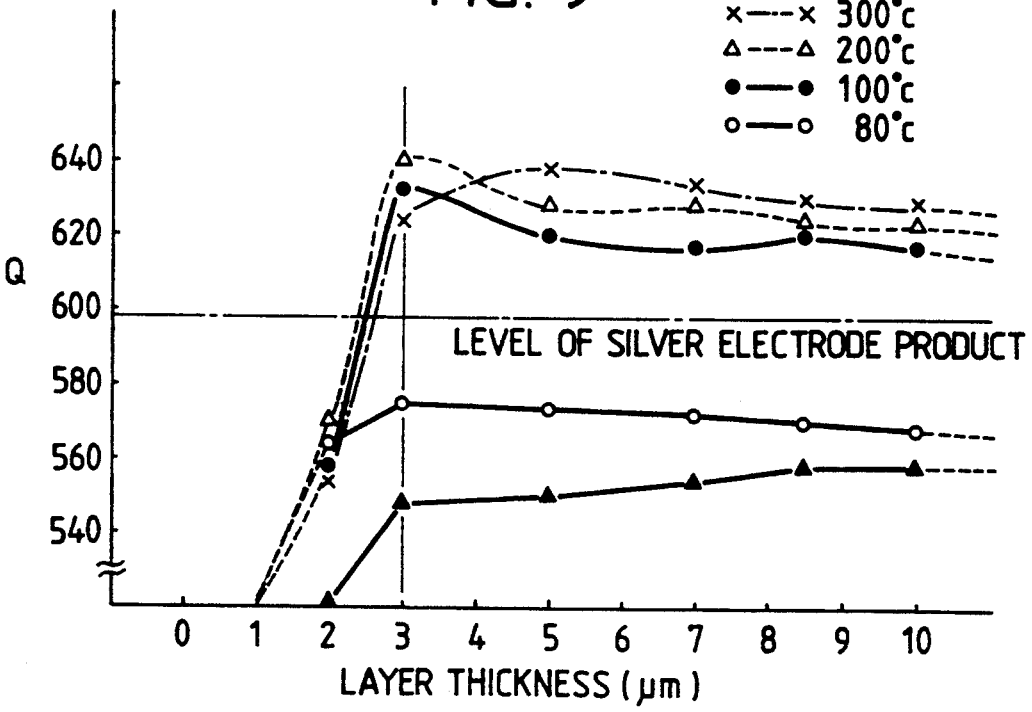
FIG. 9 is a graph to show the relationship between the layer thickness of a first conductive film according to another embodiment in the second embodiment and value Q.

That is, first, a copper film is formed by copper electroless plating on the substrate 4 in a thickness of from 0.5 μ to 2.0 μm, and another copper film is formed by copper electroplating so as to be laminated onto the first copper film in a thickness of 3 μm or more. In this way, forming first a subbing film by copper electroless plating and forming on the subbing film another copper film by copper electroplating makes it possible to form the first conductive film at a higher rate (i.e., in a shorter time). The reason therefor is as follows: If it is attempted to form a copper film by copper electroless plating, the film is formed at a very law rate. Hence, the first conductive film could be formed at a higher rate if, after the copper film has been formed by copper electroless plating to a certain extent, the film is formed by copper electroplating that enables film-formation at a high rate. If so, it may be considered that the film should be formed by copper electroplating from the beginning. Since, however, the substrate 4 is comprised of a ceramic, i.e., an insulator, no copper film can be formed on the substrate 4 if the copper electroplating is applied from the beginning. Also in regard to this another embodiment constituted as described above, the relationship of the value Q of the dielectric resonator with respect to the layer thickness of the first conductive film and the heating temperature is shown in FIG. 9. As will be seen from FIG. 9, substantially the same results as those in FIG. 8 are obtained, that is, the value Q of the dielectric resonator can be made larger when the first conductive film of the double layer structure is formed in a thickness of 3 μm or more and also the heating temperature is set in the range of from 100° C. to 300° C. In this embodiment, the second conductive film is formed by solder electroplating. The same effect can be obtained also when a tin film is formed by tin electroplating.

Figure 10:
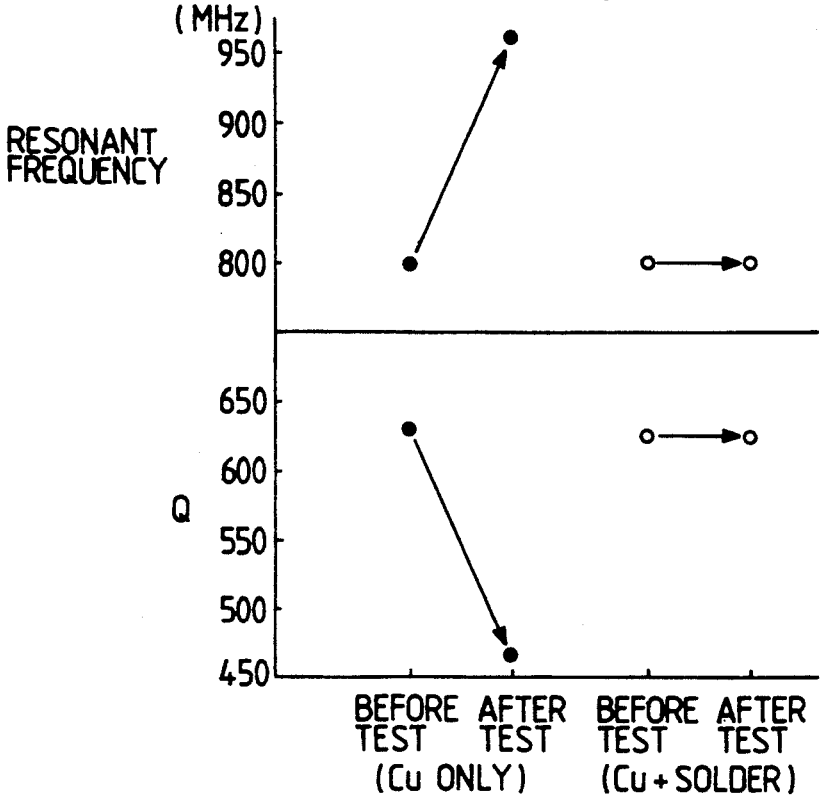
FIG. 10 is a graph to show changes in value Q and resonant frequencies before and after salt spray tests carried out on dielectric resonators according to the prior art and the second embodiment of the present invention.

Then the dielectric resonator according to another embodiment described above and a conventional dielectric resonator having a conductive film formed of only copper were subjected to salt spray tests according to JIS 5028. Results obtained are shown in FIG. 10. In FIG. 10, the changes in unloading value Q and changes in resonant frequencies before and after the salt spray tests are shown in the lower half and upper half, respectively, of the graph. As will be seen from FIG. 10, in the conventional dielectric resonator, the value Q and resonant frequencies obtained before the tests are greatly changed after the tests. This is presumably because the copper film has been corroded by salt water. On the other hand, in the dielectric resonator according to another embodiment described above, almost no changes are seen in the value Q and resonant frequencies before and after the tests.

The thickness of the second conductive film (a solder film or a tin film) will be described below. In the above second embodiment and another embodiment thereof, the second conductive film is formed in a thickness of 2 μm. In practice, the intended characteristics can be obtained if it is in a thickness of at least 1 μm. A layer thickness less than 1 μm may result in disappearance of the second conductive film because of diffusion thereof to the first conductive film during the heating, or as a result of its oxidation. Hence, the second conductive film must have a layer thickness of at least 1 μm. Although it has been stated in the above that the second conductive film 3 may have a layer thickness of not less than 1 μm, it should have a layer thickness of not more than 5 μm at most from the viewpoint of productivity. This is because a layer thickness more than 5 μm makes it necessary to carry out the plating for a long time. From the viewpoint of its characteristics, it may be in a layer thickness of not less than 1 μm without any other problem.

Figure 11:
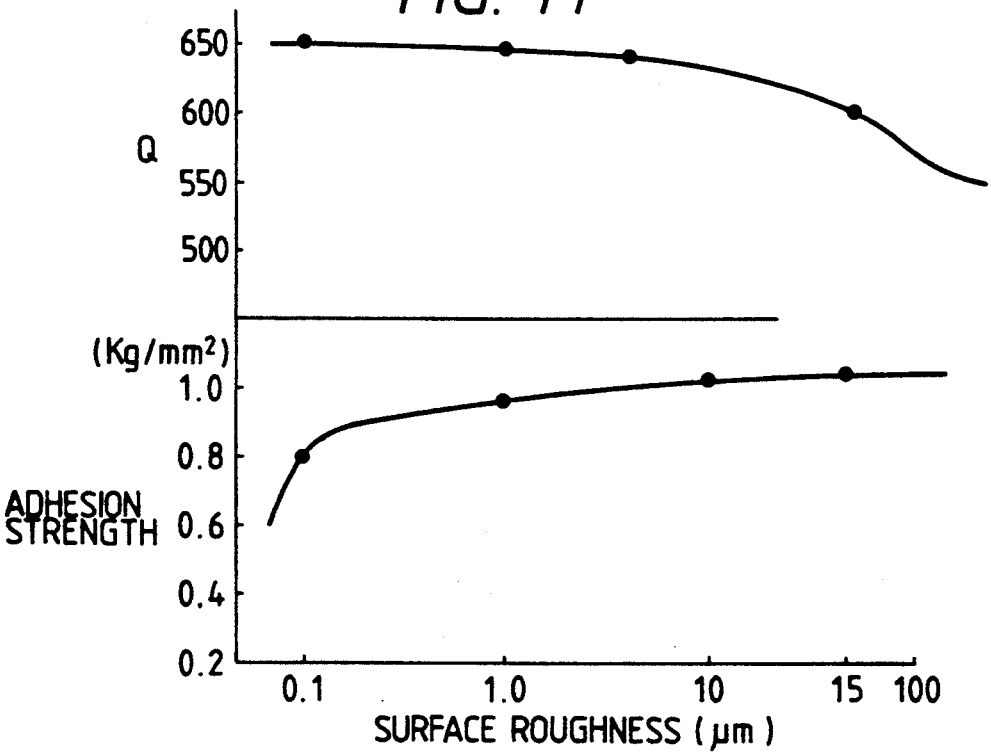
FIG. 11 is a graph to show the relationship between surface roughness of a substrate and value Q and between the surface roughness and adhesion strength of the first conductive film to the substrate, in the second embodiment of the present invention.

The surface roughness of the substrate 4 will be described below. FIG. 11 shows the relationship between surface roughness of the substrate 4 and adhesion strength of the first conductive film to the substrate, and between the surface roughness and unloading value Q, which are shown in the lower half and upper half, respectively, of the graph. As will be seen from FIG. 11, the adhesion strength becomes substantially not less than 0.8 when the surface roughness is 0.1 μm or more, and hence the surface roughness of not less than 0.1 μm is satisfactory from the viewpoint of adhesion strength. FIG. 11 also shows that the value Q abruptly decreases when the surface roughness is 15.0 μm or more. Hence, from the viewpoint of the value Q, the surface roughness should be not more than 15 μm. Thus, it is seen from the foregoing that the substrate 4 should have a surface roughness of from 0.1 μm to 15.0 μm.

As described above, according to the second embodiment of the dielectric resonator of the present invention, the first conductive film made of copper is formed on the substrate 4 and the second conductive film made of solder or tin is formed on the first conductive film. Providing of the second conductive film makes it possible to carry out the heating in the atmosphere. Hence, it becomes unnecessary to use various devices for carrying out the heating in an inert gas environment as so required in the conventional cases. Moreover, this enables reduction of the number of processing steps, resulting in an improvement in productivity. Furthermore, the heating of the substrate 4 and the first and second conductive films at temperatures of from 100° C. to 300° C. and the controlling the substrate to have a surface roughness of from 0.1 μm to 15.0 μm make it possible to obtain a high value Q and also to enhance the adhesion strength between the first conductive film and the substrate 4.

In the above embodiment, the heating is carried out in the atmosphere. The same effect can be obtained also when the heating is carried out in a high-temperature oil comprising silicone, fluid paraffin or the like.

What is claimed is:

1. A dielectric resonator comprising:

a cylindrical substrate comprised of a dielectric ceramic and having an inner surface, outer surface and opposing ends;

a first conductive film comprised of copper, formed on the inner surface, outer surface and one end of said cylindrical substrate; and a second conductive film comprised of one of solder or tin, formed on said first conductive film wherein said first conductive film is formed in a layer thickness of not less than 3μ, said second conductive film is formed in a layer thickness of from 1 μm to 5 μm and said substrate has a surface roughness of from 0.1 μm to 15.0 μm.

2. A dielectric resonator according to claim 1, wherein said first conductive film is comprised of an electroless-plated layer formed in a layer thickness of from 0.5 μm to 2.0 μm and an electroplated layer formed on said electroless-plated layer.

3. A dielectric resonator comprising;

a cylindrical substrate comprised of a dielectric ceramic;

a first conductive film comprised of copper, formed on the whole surface of said cylindrical substrate except one end thereof; said first conductive film including an end surface in the same plane as said one end; and a second conductive film comprised of one of solder or tin, formed on said first conductive film in such a manner that it covers said end surface of said first conductive film.

4. A dielectric resonator according to claim 3, wherein said first conductive film is formed in a layer thickness of not less than 3 μm and said second conductive film is formed in a layer thickness of from 1 μm to 5 μm.

5. A dielectric resonator according to claim 4, wherein said first conductive film is comprised of an electroless-plated layer formed in a layer thickness of from 0.5 μm to 2.0 μm and an electroplated layer formed on said electroless-plated layer.

6. A dielectric resonator according to claim 4, wherein said substrate has a surface roughness of from 0.1 μm to 15.0 μm.

* * * * *